United States Patent [19]

Strader

[11] 4,203,502

[45] May 20, 1980

[54] MUFFLER

[76] Inventor: Walter F. Strader, 7358 Deering Ave., Canoga Park, Calif. 91303

[21] Appl. No.: 937,143

[22] Filed: Aug. 28, 1978

[51] Int. Cl.[2] ..... F01N 1/08

[52] U.S. Cl. ..... 181/238; 181/265; 181/268; 181/272; 181/275

[58] Field of Search ..... 181/238, 265, 268, 270, 181/272, 275, 260, 266; 55/276, DIG. 30

[56] References Cited

U.S. PATENT DOCUMENTS

| | | | |
|---|---|---|---|
| 2,809,709 | 10/1957 | Billey | 181/266 |
| 2,990,028 | 6/1961 | Powers | 181/238 |
| 3,177,971 | 4/1965 | Kelly | 181/260 |
| 4,006,793 | 2/1977 | Robinson | 181/266 |

FOREIGN PATENT DOCUMENTS

| | | | |
|---|---|---|---|
| 534933 | 10/1955 | Italy | 181/268 |
| 606952 | 7/1960 | Italy | 181/268 |

*Primary Examiner*—L. T. Hix
*Assistant Examiner*—Benjamin R. Fuller
*Attorney, Agent, or Firm*—Edward J. DaRin

[57] ABSTRACT

A muffler for an internal combustion engine utilized on a motorcycle or the like. The muffler provides the necessary silencing action while being defined to be light in weight, small and pleasing in appearance. The exhaust gases are subdivided into a plurality of streams and successively conveyed through three silencing chambers. The gases are caused to change in direction and are shredded in each chamber for dissipating energy to provide the desired silencing action.

12 Claims, 11 Drawing Figures

MUFFLER

PRIOR ART AND SUMMARY OF THE INVENTION

This invention relates to mufflers and more particularly to a compact muffler for use on motorcycles or the like.

A muffler, or silencer, is a device through which the exhaust gases from an internal combustion engine are conveyed to suppress the audible vibrations. The pressure in an internal combustion engine cylinder when the exhaust valve opens causes a gas discharge from the engine at an explosive velocity. The successive discharges from the engine cyclinders set up pressure pulsations that produce a sharp barking sound. A muffler is utilized to damp out or absorb the pulsations so that the exhaust gases leave the muffler as a relatively quiet stream.

Prior art muffler contain sets of baffles that reverse the flow of exhaust gases or otherwise cause them to follow devious paths so that interference between the pressure waves reduces the pulsations. Present day mufflers for modern motor vehicles commercially employ resonant chambers communicating with the passages through which the exhaust gases flow. The chambers are defined to cancel or absorb the vibrations present in the exhaust stream in a manner to effectively reduce the noise in the exhaust gases. A muffler used on modern day automobiles utilize an inlet tube for receiving the exhaust gases and discharging the gases into the muffler proper. A discharge tube is arranged in the muffler to receive the gases after they have executed a number of flow reversals and then exit the muffler to the atmosphere through the exhaust tube. An annular chamber surrounds the discharge tubing and is constructed of a fiberglass material to absorb the high frequency vibrations. Flow reversals in a muffler are known to produce power losses caused by the generation of a back pressure.

Other prior art mufflers silence the gas stream by shredding the gases, i.e., breaking up the stream into very small streams of gases. Changing the direction of the gas stream in a muffler causes a dissipation of energy during the travel in the muffler chambers and to transmit the energy to the outer housing of the muffler.

A muffler to be used on a motorcycle must be designed differently from a muffler to be used on an automobile with regard to its overall size. A muffler for use on a motorcycle is constrained by weight, length, overall size and general appearance. Motorcycles are notoriously well known to be noisy in operation. At the present time, a muffler for use on a motorcycle is required to be sufficiently small for mounting on the motorcycle and to have a pleasing appearance, yet function to effectively silence the exhaust gases to the desired level without adversely affecting the operation of the internal combustion engine throughout its normal operating range.

The present invention provides an improved, relatively simple, lightweight and inexpensive to manufacture, muffler that is readily adaptable for use on standard motorcycles. The motorcycle muffler of the present invention produces a reduction in the sound level of the exhaust gases from a motorcycle internal combustion engine on the order of 80.1 decibels without adversely restricting the operation of the engine. The muffler of the present invention has been designed to be small in size so as not to have a bulky appearance when mounted on a motorcycle and of lightweight construction yet providing the desired silencing of the exhaust gases. The Harley-Davidson motorcycle, for example, utilizes a two cylinder, air-cooled engine which is known to be inherently harder to silence than competitive four-cyclinder engines. The muffler of the present invention is readily mounted on a standard Harley-Davidson motorcycle of present day design without substantially affecting the power output of the engine through approximately 6,500 engine revolutions per minute, RPM. The overall length of the muffler of the present invention is approximately 18 inches and has an outside diameter of approximately 2¾ inches.

From a structural standpoint, the present invention comprises a muffler having an outer tubular housing adapted to be connected at one end to receive and convey the exhaust gases from the internal combustion engine. The housing includes a muffler core of a preselected configuration comprising a plurality of exhaust chambers for silencing the audible vibrations in the gas stream. Each exhaust chamber has a partition at each end that is spaced to define the longitudinal extent of the closed exhaust chambers. Each exhaust chamber is arranged in series fashion with the other chambers for receiving the exhaust gas adjacent one partition and discharging the gas to the successive exhaust chamber through an aperture arranged in a preselected location in the common partition between chambers. Each exhaust chamber is characterized as including a gas conduit extending through a common partition between a pair of chambers for conveying or transferring the gases therebetween. The gas conduit may have a closed end at the gas entry end in one chamber and an open end at the gas discharge end in the other chamber. The entry end of the gas conduit is defined with a closed end wall arranged at a preselected angular relationship, other than a right angle, with the longitudinal axis thereof and the portion of the gas conduit extending on the gas entry side of the common partition being provided with a multiplicity of closely spaced perforations for conveying and shredding the gas as it enters the conduit through the perforations. The gas discharge portion of the gas conduit has a plurality of breather apertures spaced around its periphery and longitudinally thereof. Means is provided for conveying the exhaust gas to be silenced through a gas entry partition arranged at one end of the muffler. Means is also provided for conveying the silenced exhaust gases from a partition at the exhaust end of the muffler to exhaust the silenced gases to the atmosphere.

These and other features of the present invention may be more fully appreciated when considered in the light of the following specification and drawings, in which.

Figure 1:
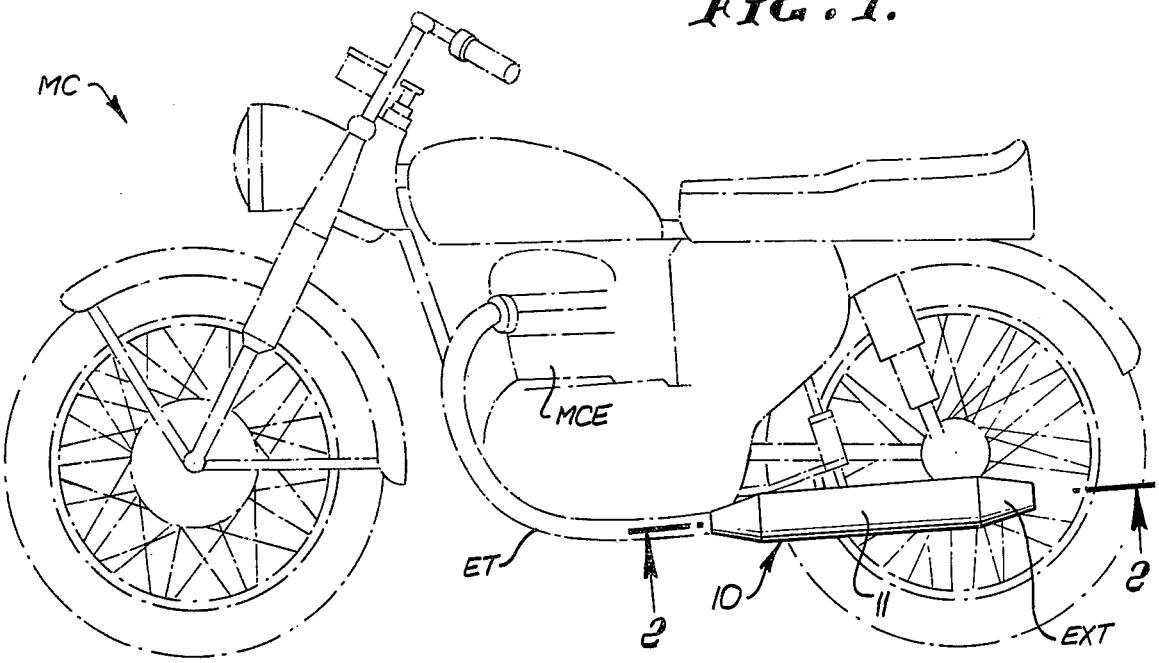
FIG. 1 is a diagrammatic representation of a motorcycle showing the muffler emboding the present invention mounted thereon.
Figure 2:
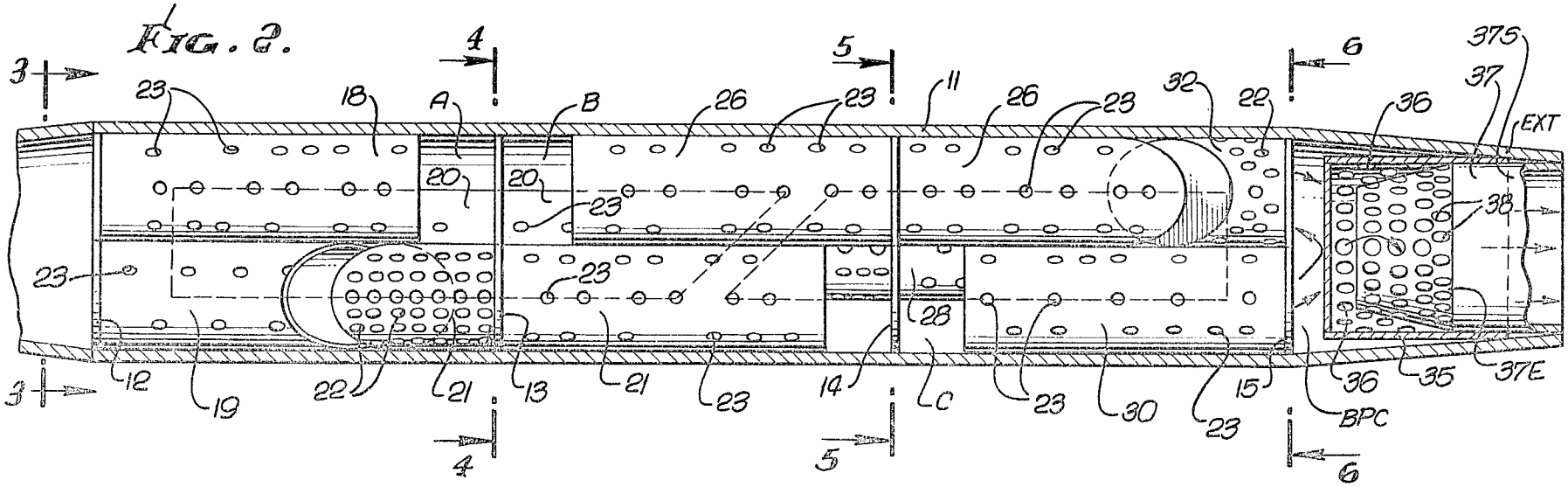
FIG. 2 is a cross-sectional view of the muffler embodying the invention taken along the line 2—2 of FIG. 1.
Figure 6:
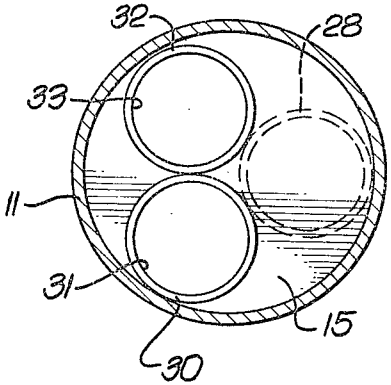
FIG. 6 is a cross-sectional view taken along the line 6—6 of FIG. 2 illustrating the exhaust apertures from the terminal exhaust chamber.
Figure 5:
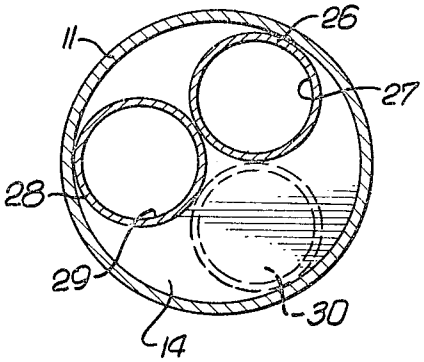
FIG. 5 is a cross-sectional view taken along the line 5—5 of FIG. 2 illustrating the communication between successive exhaust chambers.
Figure 7:
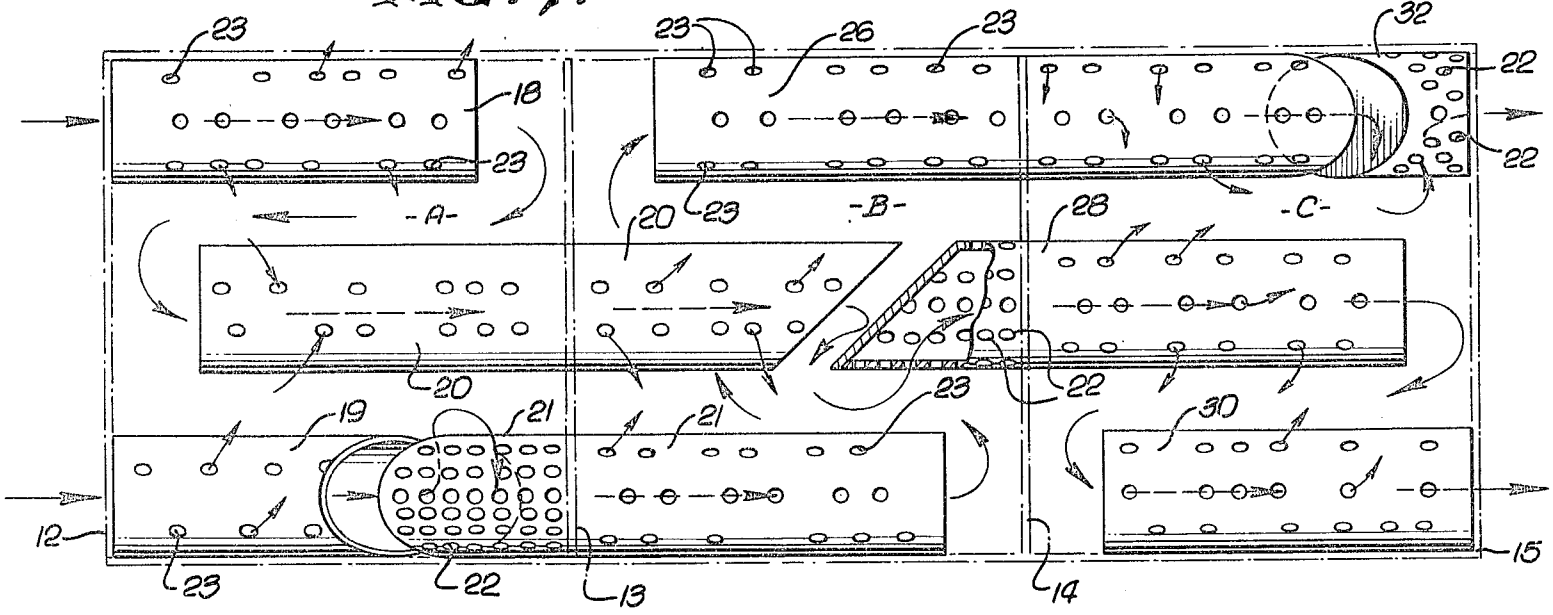
FIG. 7 is a diagrammatic, developed view of the muffler core illustrated in FIG. 2 to show the exhaust gas flow paths therein.

Now referring to the drawings, the concept of the muffler 10 of the present invention will be examined in detail. FIG. 1 illustrates the muffler 10 secured to the exhaust tube ET of a motorcycle engine MCE for a motorcycle MC. The small size and pleasing appearance of the muffler 10 can be appreciated by examining FIG. 1. The significant aspect from a structural standpoint of the muffler 10 disclosed to the art by this applicant is referred to as a muffler core. The muffler core as shown in FIGS. 2 and 7 comprises three serially arranged exhaust chamber for sequentially receiving the exhaust gases prior to being conveyed to atmosphere. The exhaust chambers are identified in FIGS. 2 and 7 as the chambers A, B and C. The exhaust gases conveyed from the chamber are conveyed to an outlet section identified as a BPC section defined to control the back pressure developed by the muffler 10 before exhausting the gases to the atmosphere. In accordance with the present invention, the muffler chamber A is defined to have a diameter of 2½–3 times the diameter of the exhaust tube ET. It has been found that when applied to a standard commercially available motorcycle, that the power of the motorcycle engine MCE will not be affected when used with the muffler of the present invention at engine speeds through the normal operational engine speeds. In addition, it has been determined that to provide the necessary silencing action at least two changes in direction of the exhaust gas stream are required in the chambers A, B and C to produce the desired silencing action. The exhaust chambers A, B and C are defined to break down the velocity of the exhaust gases and to dissipate the energy in the chambers, including transferring the energy to the outer housing for the muffler core. In this fashion the sound energy can be reduced to a level much lower than conventionally designed mufflers. The exhaust chambers A, B and C are housed within the tubular housing 11 having a tapered entry and connected to the exhaust tube ET. The entry end of the housing 11 is identified as the tapered section ET in FIG. 1 with the tapered exhaust end defined for the chamber BPC being indentified as EXT. The muffler core is arranged intermediate the entry end of the housing section ET and the exhaust section EXT.

Figure 3:
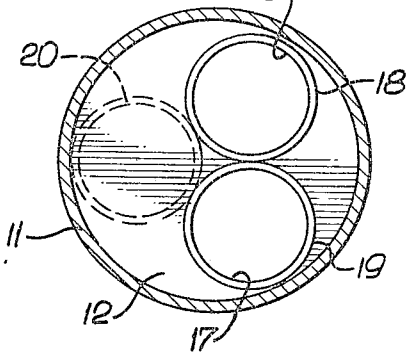
FIG. 3 is a cross-sectional view taken along the line 3—3 of FIG. 2 illustrating the gas entry aperture arranged in the entry partition of the muffler.

Now referring to FIG. 2 in particular in conjunction with FIG. 7, the internal construction of the exhaust chambers A, B and C will be examined in detail. The three exhaust chambers are defined withing the housing 11 by means of four partitions in the form of metallic plates for defining the longitudinal extent of each chamber. Each chamber has the same longitudinal dimension for the purposes of this disclosure. The chamber A is defined between the entry partition 12 and the common partition 13 for separating chambers A and B. The partition 14 separates chambers B and C, while the partition 15 terminates chamber C and separates it from the back pressure control chamber identified as BPC. The partition 12 as best illustrated in FIG. 3, is provided with a pair of exhaust entry apertures 16 and 17 for communicating between the entry section ET of the muffler housing 11 and the exhaust entry chamber A. The exhaust gas from the exhaust tube ET is conveyed from the engine MCE into the chamber A through the housing section ET by means of the entry apertures 16 and 17. The entry apertures 16 and 17 have the approximate internal diameter and are defined relative to the diameter of the outlet of the motorcycle engine MCE to have the desired area ratio of at least 1 to 1 times the diameter of the engine outlet or exhaust tube ET.

Figure 8:
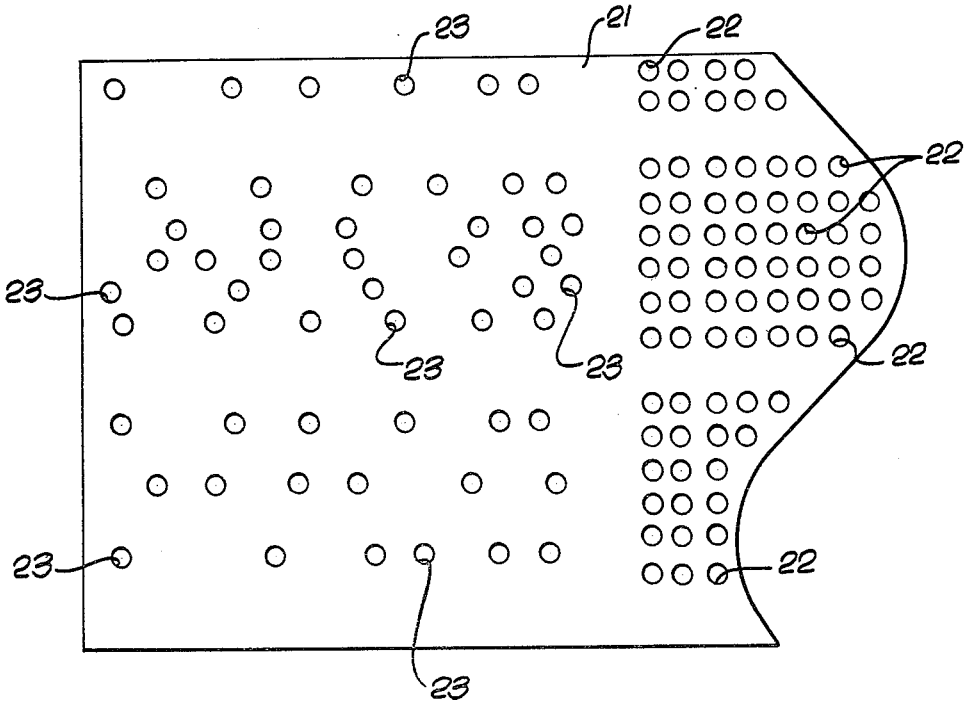
FIG. 8 is a developed view of the gas conduit having a preselected pattern of apertures for shredding the gas stream arranged btween the exhaust chambers as illustrated in FIGS. 2 and 7.

Two exhaust gas transfer tubes identified as tubes 18 and 19 are arranged in a coaxial relationship with the partition apertures 16 and 17 respectively for conveying the exhaust gas into the interior of the chamber A and sub-dividing the gas stream into two streams. The gas transfer tube 18 extends inwardly of the partition 12 so as to cause the conveyed gases to be discharged at a point adjacent to and against the common partition 13 between the chambers A and B. The gas transfer tube 19 is of a shorter length than the tube 18 and terminates intermediate the ends of the tube 18. The tube 18 has its discharge end terminating at an angular relationship with respect to its longitudinal axis, other than 90 degrees, and as illustrated in FIGS. 2 and 7, the output end of the gas transfer tube 19 is arranged at a 45 degree angle for ease of manufacture. In accordance with the present invention any angle other than 90 degrees is preferred. A 90 degree angle is used to terminate the discharge end of discharge tube 18. The exhaust gases that are conveyed into the chamber A by means of the tube 18 are exhausted from the chamber by means of a gas transfer conduit 20 extending through the partition 13 separating the chambers A and B. The portion of the transfer tube 20 which extends from the partition 13 into the chamber A is substantially the same length as the length of the tube 18 and is spaced approximately the same distance from the partition 12 that the terminal end of the tube 18 is spaced from the partition 13. The exhaust gases that are received at the input end of the tube 18 are reflected against the solid portion of partition 13 so that they change their direction of flow approximately 180 degrees in the chamber as they travel the entire length of the exhaust chamber A a second time to enter the exhaust tube 20 so as to be conveyed into chamber B; see FIG. 7. A fourth transfer tube is positioned in chamber A and is identified by the reference numeral 21. The tube 21 is also defined to extend through the partition 13 for conveying the exhaust gases from chamber A into chamber B. The end of the tube 21 has a closed flat end that is arranged in a spaced, parallel, angular relationship with the exhaust tube 19. The exhaust gases exiting from the tube 19 are reflected against the closed solid surface of the tube 21 requiring them to change their direction of flow approximately 90 degrees and to move around the tube to enter the tube 21 by means of the multiplicity of shredding apertures 22; see FIG. 7. The shredding apertures 22 comprise a multiplicity of closely spaced apertures having a preselected diameter to break up or shred the exhaust gas stream into a multiplicity of exhaust streams as they enter the tube 21. The pattern of the shredding apertures 22 can be best appreciated by examining the developed view of the shredder tube 21 as illustrated in FIG. 8.

Figure 9:
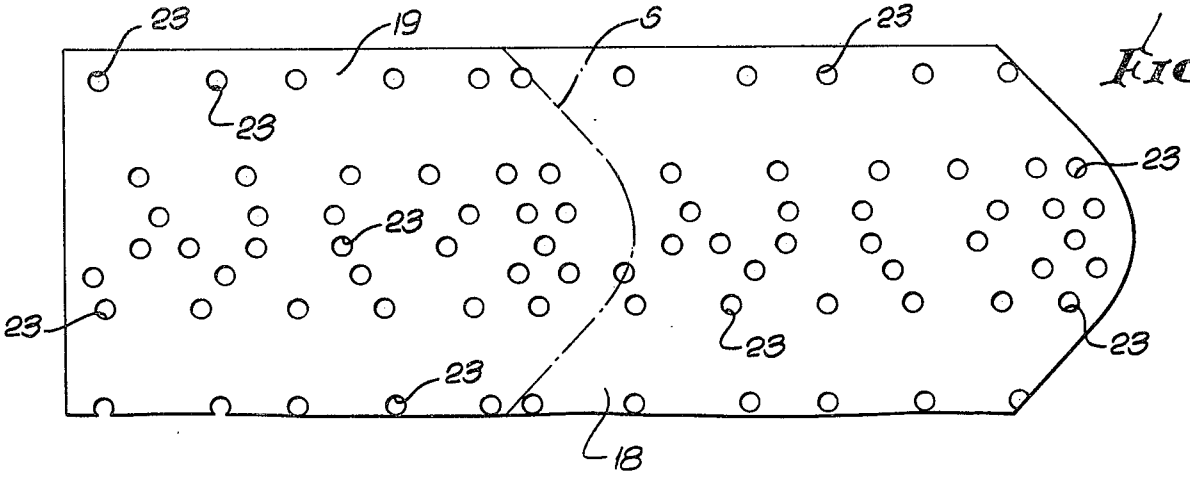
FIG. 9 is a developed view of gas transfer conduits of different lengths as illustrated in FIGS. 2 and 7 and illustrating the preselected patterns of apertures for the conduits.

Each of the gas transfer tubes 18, 19 and 20 are provided with a series of breather apertures, identified as the apertures 23, that are arranged around the periphery of the tubes and longitudinally thereof. The apertures 23 are arranged in a preselected pattern as best illustrated in the developed view of FIG. 9. The pattern is the same for each of the transfer tubes irrespective of their length. To this end the developed portion of FIG. 9 extending between the left-hand side of the Figure to the line S, represents the pattern for a short transfer tube, such as the tube 19, while the apertures 23 for the complete length of the tube 20 as illustrated in FIG. 9 from the left-hand extremity to the end, are for the longer tubes, such as tube 20. The same pattern prevails for the tube 18 and the other tubes of the muffler.

Figure 4:
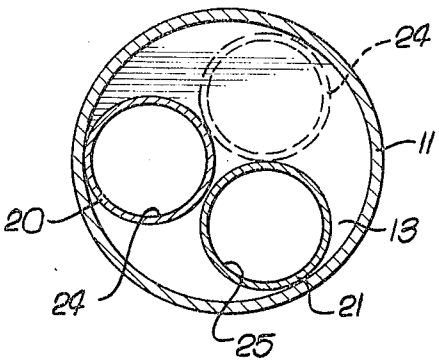
FIG. 4 is a cross-sectional view taken along the line 4—4 of FIG. 2 illustrating the communication between successive exhaust chambers.

The partition 13 separating the chambers A and B is provided with apertures 24 and 25 arranged to receive the respective tubes 20 and 21. This arrangement of the partition 13 is best appreciated by examining FIG. 4. It will be noted that there is a displacement in the travel of the exhaust gases in a horizontal direction due to the change in flow direction in the chamber A as they enter the chamber B. This can be appreciated by examining the geometrical relationship of apertures 16 and 17 with respect to apertures 24 and 25 in FIGS. 3 and 4. The transfer tubes 20 and 21 are tightly held within the apertures 24 and 25 so as to cause the exhaust gases to enter chamber B solely by means of these tubes.

The transfer tube 20 extends into chamber B a distance approximately the same as the length of the transfer tube 19 in chamber A. The exhaust end of the conduit 20 has a tapered open end the same as tube 19, as illustrated. The portion of transfer tube 21 extending into the chamber B from partition 13 has a length approximately the same as tube 18. The shreddedgases entering the tube 21 exit the tube adjacent partition 14 between chambers B and C. The gas exiting from tube 21 is reflected against partition 14 and changes direction to travel backwards towards chamber A prior to entering the exhaust tube 26; see FIG. 7. The exhaust tube 26 extends through an aperture 27 provided for the partition 14 separating chambers B and C for conveying the gas into chamber C. The gas entry end of the conduit or tube 26 is spaced on the opposite side of partition 3 approximately the same distance that tube 18 is spaced. A second gas transfer tube having the same configuration and length as tube 21 is identified as the tube 28. The tube 28 extends through and snuggly fits into an aperture 29 provided for the partition 14. The tube 28 has a closed entry end and shredding section defined the same as tube 21. The shredding apertures 22 for the tube 28 extend inwardly of partition 14 for receiving the gases exhausted from the tube 20 for conveying and shredding the gases as they are conveyed into chamber C; see FIG. 7.

The chamber C is defined similarly to chamber A but with the displacement of the gas flow as a result of the arrangement of tubes 26 and 28 extending through partition 14 by means of the respective apertures 27 and 29 provided in the partition 14. The tubes 26 and 28 are tightly held in apertures 27 and 29 so that the tubes function to convey exhaust gases into chamber C.

The portion of the tube 28 that extends into chamber C terminates adjacent partition 15 for reflecting the gases against partition 15 to provide the approximate 180 degree change in direction. An exhaust tube 30 is arranged in parallel alignment with tube 28 for receiving the gases exiting from tube 28. The tube 30 is mounted to discharge the exhaust gases into chamber BPC by means of a coaxial aperture 31 provided on the partition 15. Similarly, an exhaust tube 32 is arranged in longitudinal alignment with the tube 26 for receiving the exhaust gas therefrom and conveying them out of chamber C. The tube 32 is a short stub section of essentially the same length as portions of the tubes 21 and 28 extending in the chambers A and B respectively. The tube 32 is secured in the aperture 33 for the partition 15 to exhaust gases into the chamber BPC. The tube 32 has a closed entry end arranged in parallel relationship with the discharge end of the tube 26 and in spaced relationship therewith to cause the gases to change direction approximately 90 degrees. The periphery of tube 28 is defined with a multiplicity of shredding apertures 22 for shredding the gases as they exit from chamber C into chamber BPC.

The gas tubes in each of the chambers A, B & C are arranged in a side-by-side relationship and are maintained in position be being welded to one another and to the partitions 12–15. Three tubes are arranged in parallel alignment to assume a triangular relationship in each chamber, as is evident from examining FIGS. 3–6, to provide a rigid, stable relationship.

The chamber BPC receives the silenced exhaust gases from chamber C and is constructed and defined to control the back pressure generated by the muffler 10 at the exhaust end. This is utilized for tuning the engine. A typical construction is illustrated in FIG. 2 for this purpose. This representative structure comprises a tubular element 35 mounted in the housing section EXT having a solid closed end arranged adjacent the exhaust side of the partition 15. The side wall of the element 35 are perforated with a multiplicity of closely spaced apertures 36. The apertures 36 are approximately twice the diameter of the breather holes 23. Arranged within the tubular element 35 is another tubular element 37 having an open end spaced adjacent the closed end of the element 35. The element 37 is defined to extend to the exhaust end of the section EXT to exhaust the silenced gases to the atmosphere. The element 37 has a tapered end 37E provided with a plurality of exhaust apertures for receiving the exhaust gas from the element 36 and convey it through the solid section 37S of the element 37 to the atmosphere. The flow of the gases into the chamber BPC is against the solid surface of element 37, around the element through the apertures 36. From the apertures 36, the exhaust gases flow through the open end of the element 37 to atmosphere as well as through the apertures 38.

In summary, then, the flow of the exhaust gases can be considered as being sub-divided into two gas streams as they flow from the exhaust tube ET from the engine MCE into the muffler 10. In each chamber one gas stream is conveyed against a partition, reflected against the partition, retraverses the length of the chamber to be discharged from a transfer tube arranged in parallel alignment with the entry transfer tube and exits the chamber into the successive chamber. The other subdivided gas stream is discharged intermediate the ends of the chamber to impinge against a solid surface arranged in spaced, angular alignment with the entry discharge tube. The angular relationship preferred is 45 degrees. The remaining portion of the closed end transfer tube is provided with a multiplicity of shredding apertures to receive and shred the gases for conveyance to the adjacent chamber. The arrangement is such as to cause the gases to change direction in entering the shredding apertures.

Figure 10:
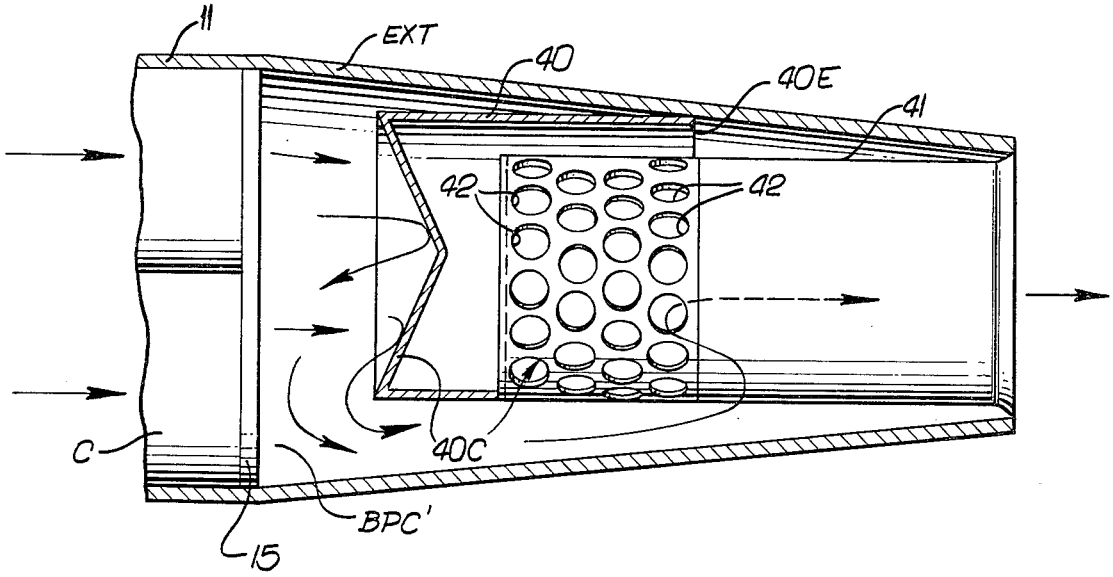
FIG. 10 is a cross-sectional view of an alternate embodiment of the output section for the muffler of FIG. 2.

In FIG. 10, another embodiment of the outlet chamber BPC′ is illustrated. The chamber BPC′ performs the same function as the chamber BPC but has a modified construction. In this embodiment, the exhaust gases discharged from the chamber C impinge against the conical surface 40C of the tubular element 40. The conical surface 40C is defined to close the end of the element 40 with the apex of the cone turned toward the open end 40E of the element 40. A further discharge element 41 is provided for exhausting the gases received from the chamber C. The element 40 and the discharge element 41 are arranged in an offset relationship, as illustrated. The lower side of the element 40 has an aperture for exposing the element 40. The upper wall of the element 40 is a solid surface and extends into engagement with the housing section EXT to close off the flow therebetween. The discharge element 41 is a tubular element extending from the discharge end of the housing section EXT to adjacent the apex of the conical surface 40C on the inside of the element 40. The portion of the element 41 that is coextensive with the element 40 is provided with a multiplicity of exhaust apertures 42 of the same size as the apertures 38 for the previous embodiment.

With the above defined chamber BPC′ the gases from the chamber C impinge against the surface 40C upon entering the chamber, are turned to flow towards the exhaust opening by passing through the exhaust apertures 42 and out through the inside of the element 41 to the atmosphere.

Figure 11:
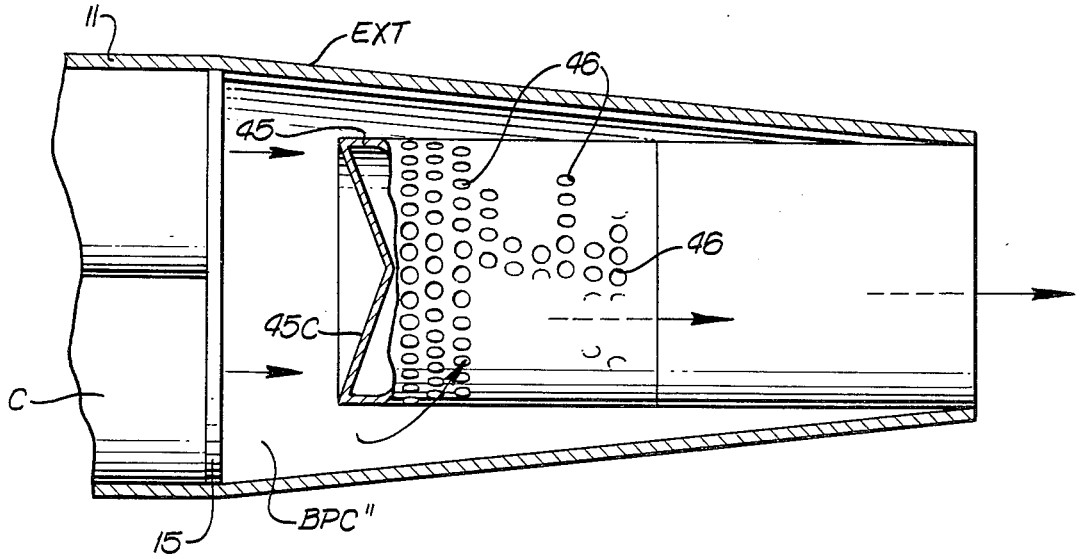
FIG. 11 is a cross-sectional view of yet another embodiment of the output section for the muffler of FIG. 2.

Now referring to FIG. 11, another embodiment of the outlet chamber is illustrated and identified as the chamber BPC″. In this embodiment, a single discharge element 45 is utilized in the chamber BPC″. The element 45 is arranged coaxially with the longitudinal axis of the chamber and is provided with a conical surface 45C opening towards the chamber C as in the previous embodiment. The outer surface of the element 45 has a perforated, screenlike area comprising perforations 46 extending a preselected distance outwardly of the inside surface of the conical surface with the remaining surface being solid as illustrated. In this embodiment the exhaust gases exit the chamber BPC″ by travelling around the element 45 and through the apertures 46 to the inside of the element. Once inside the element 46, the silenced gases travel longitudinally of the element 46 until exhausted to the atmosphere.

What is claimed is:

1. A muffler comprising an outer tubular housing adapted to be connected at one end to receive and convey the exhaust gases from an internal combustion engine therethrough; said housing including a muffler core of a preselected configuration comprising a plurality of exhaust chambers for silencing the audible vibrations in the exhaust gas stream, each chamber having a partition at each end defining the longitudinal extent of a closed chamber, each exhaust chamber being arranged in serial arrangement for receiving the exhaust gases adjacent one partition and discharging the gases to the successive exhaust chamber through an aperture arranged at a preselected location in the other partition, each exhaust chamber is characterized as comprising a gas conduit extending through a common partition between a pair of chambers for conveying the gases therebetween, said gas conduit having a closed end at the gas entry end thereof in one chamber and an open end at the gas discharge end thereof in the other chamber, the entry end of the gas conduit being defined with a closed end wall arranged at a preselected angular relationship, other than a right angle, with the longitudinal axis thereof and the portion of the gas conduit extending on the gas entry side of a partition being provided with a multiplicity of closely spaced perforations for conveying and shredding the gas as it enters through the perforations, the gas discharge portion of the gas conduit having a plurality of apertures spaced therearound and longitudinally thereof in a preselected spacing, first means for conveying a portion of the exhaust gases to be silenced through the gas entry partition at one end of the muffler for impingement with the intra-chamber partition for causing said exhaust gases to reverse their direction of flow, second means for conveying the remaining portion of the exhaust gases to be silenced through the gas entry partition at one end of the muffler for impingement with the closed end of said gas conduit and to exit the chamber through said multiplicity of closely spaced perforations, the exhaust gases exiting said gas conduit so as to impinge against the partition at the opposite end of the muffler, third means arranged in the intra-chamber partition for receiving and conveying the exhaust gases discharged into the chamber including by said first means for discharging the exhaust gases into the adjacent chamber, and means for conveying the silenced exhaust gases from the partition at the opposite end of the muffler.

2. A muffler comprising an outer tubular housing adapted to be connected at one end to receive and convey the exahust gases fron an internal combustion engine therethrough, said housing including a muffler core of a preselected configuration comprising a plurality of exhaust chambers for silencing the audible vibrations in the exhaust gas stream, each chamber having a partition at each end defining the longitudinal extent of a closed chamber, each exhaust chamber being arranged in serial arrangement for receiving the exhaust gases adjacent one partition and discharging the gases to the successive exhaust chamber through an aperture arranged at a preselected location in the other partition, each exhaust chamber is characterized as comprising a pair of exhaust gas conduits secured to the gas entry partition in a side-by-side relationship and adapted to receive and sub-divide the exhaust gas stream into separate gas streams to be conveyed through each of the conduits, one of the gas conduits having its outlet end spaced adjacent the inner partition of the gas entry chamber to cause the conveyed gases to impinge thereon, the other gas conduit having its outlet end terminating at an angular relationship, other than 90 degrees, intermediate the ends of said one gas conduit, a third gas conduit arranged to extend through said inner partition of the gas entry chamber into both the gas entry chamber and the successive gas chamber, the third conduit being arranged in parallel, alongside said one gas conduit and having its inlet end spaced adjacent the inner end of the gas entry partition for receiving and conveying gases from the gas entry chamber into the adjacent gas chamber, each of said three gas conduits having a multiplicity of spaced apertures extending around the entire periphery of the conduit and longitudinally spaced thereon in a preselected pattern, a fourth gas conduit arranged to extend through said inner partition of the gas entry chamber into both the gas entry chamber and the successive gas chamber, the fourth gas conduit being arranged in longitudinal alignment with said other gas conduit and being spaced therefrom, the fourth gas conduit having a closed entry end that is defined in a parallel, spaced relationship with the angular outlet of said other gas conduit, the outer surface of said fourth gas conduit being provided with a multiplicity of gas entry apertures closely spaced adjacent one another for shredding the gas stream emerging from said other gas conduit, said fourth gas conduit extending into the adjacent gas chamber with its outlet end terminating adjacent the inner partition of said adjacent gas chamber to cause the exiting gas stream to impinge against said partition, a fifth gas conduit extending through said inner partition of said adjacent gas chamber into both said adjacent gas chamber and the gas outlet chamber adjacent thereto, said fifth gas conduit being arranged in parallel, alongside the fourth gas conduit and having its inlet end spaced adjacent the inner end of said inner partition for the gas entry chamber for receiving and conveying gases from said adjacent chamber into the gas outlet chamber, the portion of the third gas conduit extending into said adjacent gas chamber being arranged on the opposite side of the fifth gas conduit from the fourth gas conduit, the outlet end of said portion of the third gas conduit terminating in an angular relationship, other than 90 degrees, intermediate the ends of the fifth gas conduit, each of the conduit portions arranged in said adjacent gas chamber having a multiplicity of spaced apetures extending around their peripheries and longitudinally spaced thereon in a preselected pattern, a sixth gas conduit arranged to extend through the inner partition for said adjacent gas chamber into both said adjacent gas chamber and the outlet gas chamber, the sixth gas conduit being arranged in longitudinal alignment with said third gas conduit and being spaced therefrom, the sixth gas conduit having a closed entry end that is defined in a parallel, spaced relationship with the angular outlet of the third gas conduit, the outer surface of said sixth gas conduit being provided with a multiplicity of gas entry apertures closely spaced adjacent one another for shredding the gas stream emerging from said third gas conduit, said sixth gas conduit extending into the adjacent gas chamber with its outlet end terminating adjacent the inner partition of the gas outlet chamber to cause the exiting gas stream to impinge against said partition, a seventh gas conduit secured to the outer partition of the gas outlet chamber and being arranged in parallel, alongside said sixth gas conduit and having its inlet end spaced adjacent the inner end of the gas outlet partition for receiving and conveying gases from the gas outlet chamber to be exhausted, said outer partition having an aperture coaxial with the seventh gas conduit for exhausting the gas from the outlet chamber, the portion of the fifth gas conduit extending into the gas outlet chamber having its outlet end terminating at an angular relationship, other than 90 degrees, intermediate the ends of the seventh gas conduit, and an eighth gas conduit secured to the outer partition of the gas outlet chamber and being arranged in longitudinal alignment with said fifth gas conduit and being spaced therefrom, the eighth gas conduit having a closed entry end that is defined in a parallel, spaced relationship with the angular outlet of the fifth gas conduit, the outer surface of the eight gas conduit being provided with a multiplicity of gas entry apertures closely spaced adjacent one another for shredding the gas stream emerging from the fifth gas conduit, said outer partition having an aperture coaxial with said eighth gas conduit for exhausting the gas from the outlet chamber.

3. A muffler defined in claim 2 wherein said outlet ends terminating in an angular relationship are defined at an angle on the order of 45 degrees.

4. A muffler as defined in claim 2 or 3 including means connected to said outer partition for exhausting the gas from the muffler and being constructed and defined to control the back pressure of the muffler.

5. A muffler as defined in claim 2 including output means connected to said outer partition for receiving the exhaust gases from the seventh and eighth gas conduits and exhausting the gases to the atmosphere through means constructed and defined for controlling the back pressure and thereby the power losses at the engine.

6. A muffler as defined in claim 5 wherein said output means comprises means for receiving the exhaust gases for changing their direction of flow prior to being exhausted and means for receiving the exhausted gases after their direction of flow has been changed for further shredding the gases immediately prior to being exhausted to the atmosphere.

7. A muffler comprising an outer tubular housing adapted to be connected at one end to receive and convey the exhaust gases from an internal combustion engine therethrough, said housing including a muffler core of a preselected configuration comprising a plurality of exhaust chambers for silencing the audible vibrations in the exhaust gas stream, each chamber having a partition at each end defining the longitudinal extent of a closed chamber, each exhaust chamber being arranged in serial arrangement for receiving the exhaust gases adjacent one partition and discharging the gases to the successive exhaust chamber through an aperture arranged at a preselected location on the other partition, each exhaust chamber is characterized as comprising a pair of exhaust gas conduits secured to the gas entry partition in a side-by-side relationship and adapted to receive and sub-divide the exhaust gas stream into separate gas streams to be conveyed through each of the conduits, one of the gas conduits having its outlet end spaced adjacent the inner partition of the gas entry chamber to cause the conveyed gases to impinge thereon, the other gas conduit having its outlet end terminating at an angular relationship, other than 90 degrees, intermediate the ends of said one gas conduit, a third gas conduit arranged to extend through said inner partition of the gas entry chamber into both the gas entry chamber and the successive gas chamber, the third conduit being arranged in parallel, alongside said one gas conduit and having its inlet end spaced adjacent the inner end of the gas entry partition for receiving, and conveying gases from the gas entry chamber into the adjacent gas chamber, each of said three gas conduits having a multiplicity of spaced apertures extending around the entire periphery of the conduit and longitudinally spaced thereon in a preselected pattern, a fourth gas conduit arranged to extend through said inner partition of the gas entry chamber into both the gas entry chamber and the successive gas chamber, the fourth gas conduit being arranged in longitudinal alignment with said other gas conduit and being spaced therefrom, the fourth gas conduit having a closed entry end that is defined in a parallel, spaced relationship with the angular outlet of said other gas conduit, the outer surface of said fourth gas conduit being provided with a multiplicity of gas entry apertures closely spaced adjacent one another for shredding the gas stream emerging from said other gas conduit, said fourth gas conduit extending into the adjacent gas chamber with its outlet end terminating adjacent the inner partition of said adjacent gas chamber to cause the exiting gas stream to impinge against said partition, a fifth gas conduit being connected to said inner partition of said adjacent gas chamber and being arranged in parallel, alongside the fourth gas conduit and having its inlet end spaced adjacent the inner end of said inner partition for the gas entry chamber for receiving and conveying gases from said adjacent chamber to be exhausted, the portion of the third gas conduit extending into said adjacent gas chamber being arranged on the opposite side of the fifth gas conduit from the fourth gas conduit, the outlet end of said portion of the third gas conduit terminating in an angular relationship, other than 90 degrees, intermediate the end of the fifth gas conduit, each of the conduit portions arranged in said adjacent gas chamber having a multiplicity of spaced apertures extending around ther peripheries and longitudinally spaced thereon in a preselected pattern, a sixth gas conduit arranged to extend through the inner partition for said adjacent gas chamber and being arranged in longitudinal alignment with said third gas conduit and being spaced therefrom, the sixth gas conduit having a closed entry end that is defined in a parallel spaced relationship with the angular outlet of the third gas conduit, the outer surface of said sixth gas conduit being provided with a multiplicity of gas entry apertures closely spaced adjacent one another for shredding the gas stream emerging from said third gas conduit, and means connected to the outer side of said inner partition for said adjacent gas chamber and coupled to the fifth and sixth gas conduits for exhausting the gases to atmosphere received from the fifth and sixth conduits.

8. A method for silencing the exhaust gases from an internal combustion engine or the like comprising the steps of subjecting the exhaust gases from the engine to a muffler wherein the muffler cross-section has a preselected area ratio greater than the area of the outlet conduit for the engine, defining the muffler with a plurality of sequentially arranged silencing chambers so as to cause the exhaust gases to be silenced as they are conveyed into the input silencing chamber from the engine and exhausted into the atmosphere from the output silencing chamber, separating portions of the gases into at least two gas streams as the gases are conveyed into each silencing chamber and changing the direction of flow of each of the gas streams in the chambers from the direction of flow that the gas streams entered the chamber, the direction of flow that each gas stream is changed in a silencing chamber is in a different direction conveying each gas stream from one chamber to the adjacent chamber to cause a direction change in each gas stream in both directions in being conveyed through adjacent silencing chambers and shredding the exhaust gases into a multiplicity of separate gas streams while being conveyed through a silencing chamber for silencing the exhaust gases prior to the time each portion of the exhaust gas streams exits the chambers; and exhausting the silenced gases into the atmosphere from the output silencing chamber.

9. A method for silencing the exhaust gases from an internal combustion engine as defined in claim 8 wherein a major portion of one of the portions of the exhaust gas stream is caused to change its direction of flow approximately 180 degrees in the chamber and the major portion of the remaining portion of the gas stream is caused to change its direction of flow approximately 90 degrees prior to exiting the chamber.

10. A method for silencing the exhaust gases from an internal combustion engine as defined in claim 8 or 9 wherein a portion of the gas stream is caused to change its entry direction of flow by causing the major portion of the gas stream to impinge against a solid surface that is arranged at an angular relationship, other than 90 degrees, to the direction of entry of the gas stream.

11. A method for silencing the exhaust gases from an internal combustion engine as defined in claim 10 wherein the portion of the gas stream that impinges said angularly arranged surface is caused to be shredded into a multiplicity of individual gas streams prior to exiting the chamber.

12. A method for silencing the exhaust gases from an internal combustion engine as defined in claim 11 wherein three silencing chambers are provided and are arranged in serial fashion for conveying and silencing the exhaust gases, and wherein the portions of the gas streams have their individual flow paths displaced horizontally and vertically as they are conveyed through the three silencing chambers.

* * * * *